United States Patent [19]

Kaiser

[11] Patent Number: 4,577,137

[45] Date of Patent: Mar. 18, 1986

[54] ELECTRODE STRUCTURE FOR AN ELECTRON MULTIPLIER CAGE ASSEMBLY

[75] Inventor: Donald B. Kaiser, Lancaster, Pa.

[73] Assignee: RCA Corporation, Princeton, N.J.

[21] Appl. No.: 611,754

[22] Filed: May 18, 1984

[51] Int. Cl.[4] ..... H01J 40/04; H01J 43/26; H01J 19/42

[52] U.S. Cl. ..... 313/533; 313/536; 313/261

[58] Field of Search ..... 313/536, 533, 532, 535, 313/261

[56] References Cited

U.S. PATENT DOCUMENTS

| | | | |
|---|---|---|---|
| Re. 30,249 | 4/1980 | Faulkner | 313/104 |
| 2,862,135 | 11/1958 | Payne | 313/261 X |
| 3,119,037 | 1/1964 | Stanley . | |
| 4,125,793 | 11/1978 | Timan . | |
| 4,184,098 | 1/1980 | Morales . | |
| 4,415,832 | 11/1983 | Faulkner et al. | 313/533 |

OTHER PUBLICATIONS

U.S. patent application entitled, "Photomultiplier Tube Having an Electron Multiplier Cage Assembly with Uniform Transverse Spacing", by A. F. McDonie et al., filed concurrently herewith, (RCA 80,965), Ser. No. 611,753.

U.S. patent application entitled, "Shield Cup to Cage Assembly Connecting Tab Member", by A. F. McDonie et al., filed concurrently herewith, (RCA 81,007) Ser. No. 611,873.

U.S. patent application entitled, "Photomultiplier Tube Having an Improved Centering and Cathode Contacting Structure", by D. B. Kaiser, filed concurrently herewith, (RCA 81,008), Ser. No. 611,958.

*Primary Examiner*—Palmer C. DeMeo

*Attorney, Agent, or Firm*—Eugene M. Whitacre; Dennis H. Irlbeck; Vincent J. Coughlin, Jr.

[57] ABSTRACT

A photomultiplier tube comprises an evacuated envelope having a photoemissive cathode, a shield cup spaced from the cathode and an electron multiplier cage assembly abutting the shield cup. The cage assembly includes a pair of transversely spaced support plates having a plurality of support slots formed therethrough. The support plates are attached to the shield cup. A plurality of electrodes are disposed between the support plates. At least one of the electrodes has reference apertures therein and a mesh member attached thereto which has locating slots aligned with the reference apertures. The electrodes have an active portion and attachment tabs which are disposed within the support slots in the support plates to support the electrodes therebetween. The electrodes also have support shoulders formed in opposite sides thereof between the active portion and the attachment tabs. The support shoulders have a width greater than that of the slots in the support plates, whereby the support shoulders provide stop locations adjacent to the support plates.

6 Claims, 6 Drawing Figures

ELECTRODE STRUCTURE FOR AN ELECTRON MULTIPLIER CAGE ASSEMBLY

BACKGROUND OF THE INVENTION

The present invention relates to photomultiplier tubes and, more particularly, to tubes having a plurality of electrodes, including secondary dynodes and an anode, at least one of the electrodes having reference means formed therein and a mesh member attached thereto. The mesh member includes locating means for aligning the mesh member with the reference means. The electrodes each have support shoulders formed therein which provide stop locations adjacent to the support plates which carry the electrodes to prevent the mesh members from contacting the support plates.

In the manufacturing of a high volume photomultiplier tube, conflicting objectives are frequently encountered. The tube must be designed to provide accurate and reproducible measurement of the phenomenon being observed, and yet the tube must be inexpensive to produce. The former objectives demand that the position of each element of the tube be fixed accurately with respect to the other tube elements; however, this must be done without the use of a large number of expensive precision parts. In order to achieve the latter objective, the tube must be easy to assemble in order to eliminate the need for difficult, time consuming assembly techniques.

U.S. Pat. No. 4,125,793, issued to Timan on Nov. 14, 1978, discloses a photomultiplier tube having a box and grid (i.e., dynode mesh) structure with a floating anode that is not supported by the insulating side supports which rigidly hold the dynodes in fixed spatial relation. The purpose of the floating anode is to isolate the anode from the side supports which are disclosed to carry ohmic leakage or leakage currents. There is no disclosure concerning the manner in which the dynodes are affixed to the side supports or of the need for accurately locating and aligning the mesh with the dynodes to prevent deformation by the side supports.

It has been found that in an electron multiplier structure, such as that disclosed in the Timan patent, in which a dynode mesh extends across the dynodes, improper alignment of the mesh permits the mesh to contact the insulating side supports which frequently deform the dynode mesh to the point where the mesh alters the electrostatic field of the dynode causing a decrease in tube performance. Severe distortion of the mesh may even result in the mesh contacting an adjacent electrode, causing an electrical short.

It is therefore desirable to provide a means for accurately aligning the dynode mesh with the dynodes and to prevent the mesh from contacting the insulating supports which support the dynodes. The means must be cost effective yet simple to use in order to eliminate the need for complex and time consuming assembly techniques.

SUMMARY OF THE INVENTION

A photomultiplier tube comprises an evacuated envelope having therein a photoemissive cathode, a shield cup spaced from the cathode and an electron multiplier cage assembly abutting the shield cup. The cage assembly includes a pair of transversely spaced insulating support plates having a plurality of support slots formed therethrough. The support plates are attached to the shield cup. A plurality of electrodes are disposed between the support plates. At least one of the electrodes includes reference means and a mesh member attached thereto. The electrodes have an active portion and attachment means which are disposed within the support slots in the support plates to support the electrodes therebetween. The electrodes also have support shoulders formed in opposite sides thereof between the active portion and the attachment means. The support shoulders have a width greater than that of the slots, whereby the shoulders provide stop locations adjacent to the support plates. The mesh member has locating means which align the mesh with the reference means of at least one electrode.

DETAILED DESCRIPTION OF THE PREFERRED EMBODIMENT

Figure 1:
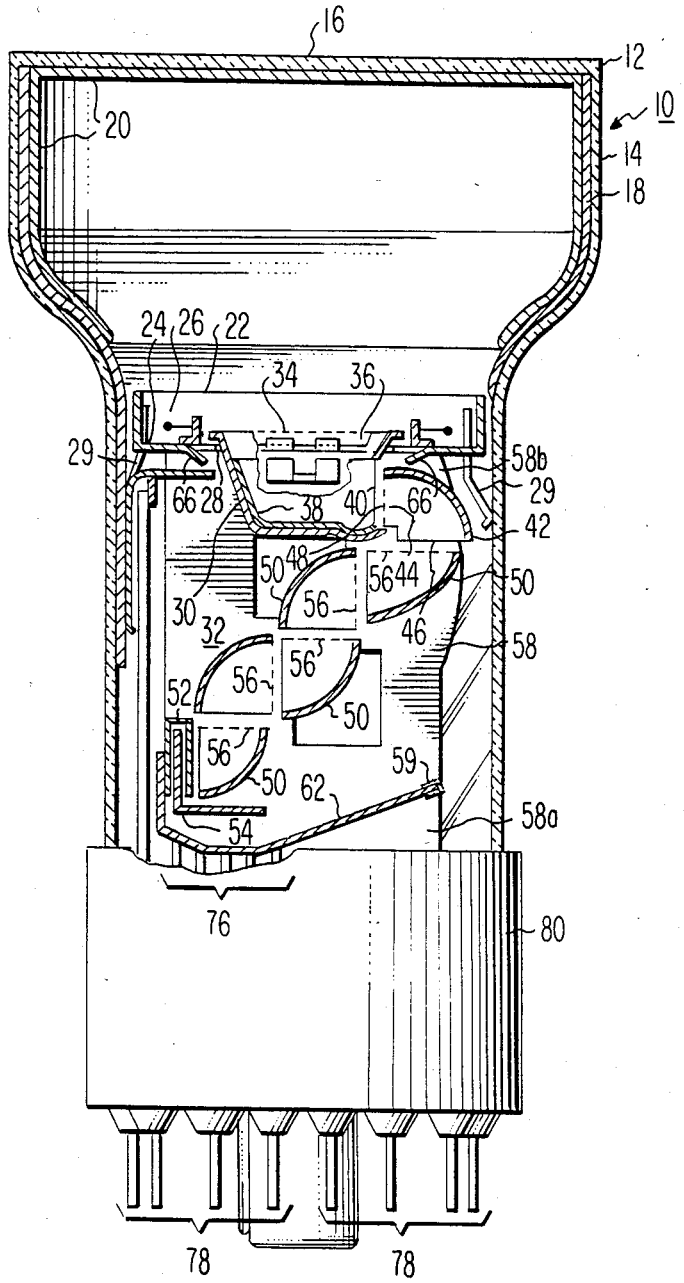
FIG. 1 is a sectional view partially broken away of a photomultiplier tube embodying the present invention.

A photomultiplier tube 10, shown in FIG. 1, comprises an evacuated envelope 12 having a sidewall 14. The envelope 12 is closed at one end by a transparent faceplate 16 and at the other end by a stem portion (not shown). A conductive layer 18 is vapor deposited on an interior portion of the sidewall 14 adjacent to the faceplate 16. A photoemissive cathode 20 is formed on the interior surface of the faceplate 16 and also along a portion of the conductive layer 18 on the sidewall 14. The photoemissive cathode 20 may comprise any of the alkali-antimonide materials known in the art. The photoemissive cathode 20 emits photoelectrons in response to radiation incident thereon.

A shield cup 22 is provided in spaced relation to the photoemissive cathode 20. The shield cup 22 is a cup-shaped field forming electrode having a substantially flat base portion 24 and an annular wall portion 26 disposed perpendicular to the base portion 24. A centrally disposed, substantially rectangular aperture 28 extends through the base portion 24 of the shield cup 22. The shield cup 22 is centered within the envelope 12 by a plurality of bulb spacers 29. A primary dynode 30 is disposed within the aperture 28 and is spaced therefrom. The primary dynode 30 has a cross-sectional contour substantially identical to that described in U.S. Pat. No. Re. 30,249, issued to R. D. Faulkner on Apr. 1, 1980, and comprises the first electrode of an electron multiplier cage assembly 32. A substantially flat primary field mesh member 34 is affixed to an input aperture 36 of the primary dynode 30. The primary dynode 30 preferably comprises a nickel substrate with an alkali-antimonide secondary emission coating 38 formed thereon. Alternatively, the primary dynode may be formed of a beryllium-copper material having a beryllium-oxide secondary emissive surface. The primary dynode 30 has an output aperture 40.

The electron multiplier cage assembly 32 further includes a box-like secondary dynode 42 which acts as a receiving member for secondary electrons emitted from the secondary emission coating 38 of the primary dynode 30. The dynode 42 has an input end 44 and an output end 46. A substantially rectangular secondary field mesh member 48 extends across the input end of the secondary dynode 42. A plurality of additional substantially-identical box-like secondary dynodes 50 are disposed between the secondary dynode 42 and an ultimate secondary dynode 52. The secondary dynodes 42 and 50 have a substantially quarter-round cross section. The ultimate secondary dynode 52 encloses an anode 54. Each of the secondary dynodes 42, 50 and 52 is preferably formed of nickel and has an alkali-antimonide coating (not shown) formed on the inside surface thereof so that the dynode can propagate electron emission from the cathode 20 to the anode 54. Each of the secondary dynodes 50 includes a substantially rectangular field mesh member 56 disposed across the input end thereof. The primary dynode 30, the secondary dynodes 42, 50, 52 and the anode 54 are disposed between a pair of substantially parallel, transversely spaced apart insulating support plates 58 (only one of which is shown in FIG. 1). The support plates 58 have a distal end 58*a* and a proximal end 58*b*. A shield notch 59 is formed along one side of each of the support plates 58 to accommodate a shield tab (not shown) of a light shield 62 which extends transversely between the support plates 58 and closes the lower end of the cage assembly 32. The light shield 62 includes a pair of weld tabs 64, shown in FIG. 2, which facilitate attachment of the light shield 62 to the ultimate dynode 52.

Figure 2:
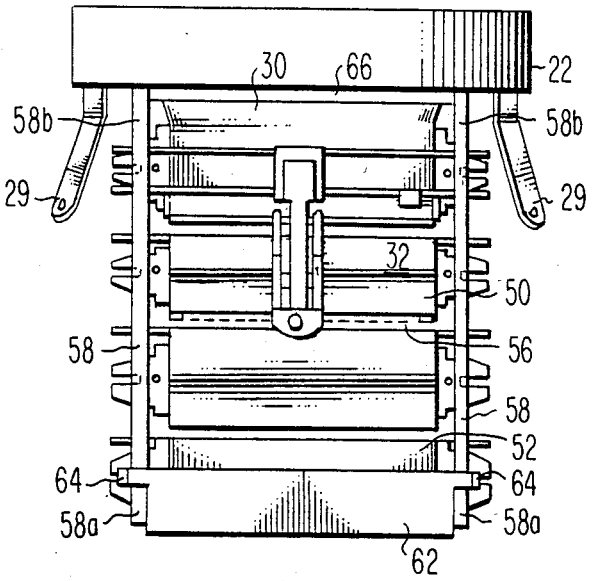
FIG. 2 is a side view of an electron multiplier cage assembly.

As shown in FIGS. 1 and 2, support plate spacing means, comprising a plurality of flaps 66, are struck from the body of the shield cup 22 by slitting the base portion 24 adjacent to the centrally disposed aperture 28. The flaps 66 are described in a copending U.S. patent application Ser. No. 611,753, filed concurrently herewith and entitled, "PHOTOMULTIPLIER TUBE HAVING AN ELECTRON MULTIPLIER CAGE ASSEMBLY WITH UNIFORM TRANSVERSE SPACING", by A. F. McDonie et al. Each of the flaps 66 has a minimum width that is slightly greater than the transverse dimension or width of the secondary dynodes 42, 50, 52 and the anode 54. The minimum transverse dimension of the portion of the light shield 62 disposed between the distal ends 58*a* support plates 58 is designed to be equal to that of the flaps 66, so that the flaps 66 and the light shield 62, in combination, provide a uniform minimum transverse spacing between the pair of support plates 58 which is greater than the transverse dimension of the secondary dynodes 42, 50, 52 and of the anode 54.

Figure 3:
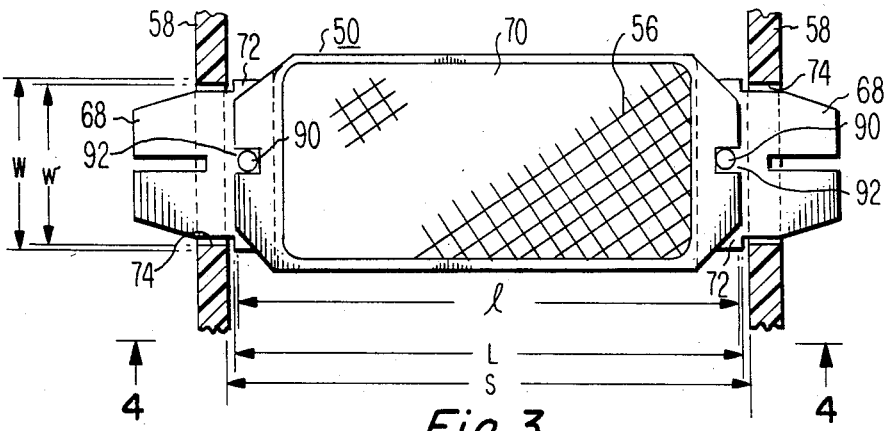
FIG. 3 is a fragmentary view of a portion of the electron multiplier cage assembly showing the top of a secondary dynode with a mesh member attached thereto.
Figure 4:
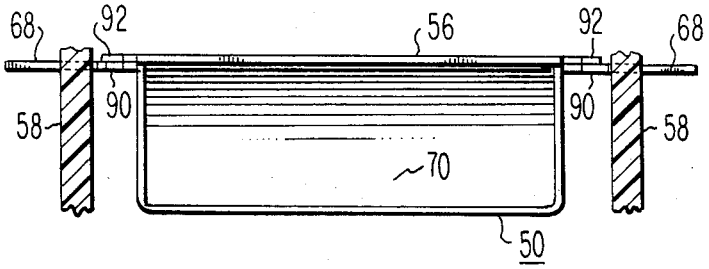
FIG. 4 is a view taken along line 4—4 of FIG. 3.

One of the secondary dynodes 50 is shown in FIGS. 3 and 4. The dynode 50 includes attachment means comprising end tabs 68 which are formed in the oppositely disposed sides of the dynode. The dynode 50 further includes an active region 70 which is secondary emissive. A pair of support shoulders 72 extend from the opposite sides of the active region 70 and terminate in the end tabs 68 which project outwardly from the support shoulders 72. Each of the end tabs 68 is designed to fit within one of a plurality of support slots 74 which are formed through each of the insulating support spacers 58. Electrical connections to the photocathode 20, to the dynodes 30, 42, 50 and 52, as well as to the anode 54, are provided by means of leads 76 which are connected to pins 78 in a base 80. Reference means comprising a reference aperture 90 are formed in each of the support shoulders 72. The reference apertures 90 are used to locate and align the substantially rectangular mesh member 56 which is attached to the input end of the dynode 50.

The dynode 50 has a transverse dimension, L, as measured across the support shoulders 72 of about 21.84±0.05 mm (0.860±0.002 inches). The center-to-center spacing of the reference apertures 90 is about 20.83±0.05 mm (0.820±0.002 inches). The mesh member 56 has a transverse dimension, l, of about 21.59 mm (0.85 inches). A pair of locating slots 92 are formed in the oppositely disposed short sides of the rectangular mesh member 56. By the use of suitable locating pins (not shown), which are disposed within the apertures 90 during the fabrication of the cage assembly 32, the mesh 56 may be accurately located on the dynode 50 and affixed thereto by welding.

As described in the copending patent application filed by A. F. McDonie et al. entitled, "PHOTOMULTIPLIER TUBE HAVING AN ELECTRON MULTIPLIER CAGE ASSEMBLY WITH UNIFORM TRANSVERSE SPACING", the minimum transverse spacing, S, between the support spacers 58 is constrained to be 22.05±0.05 mm (0.868±0.002 inches). The novel dynode 50, with reference apertures 90 formed in the support shoulders, thus provides a slight transverse gap between the edges of the support shoulders 72 and the inside surfaces of the support plates 58. Additionally, since the transverse dimension, l, of the mesh member 56 is less than the transverse dimension, L, of the support shoulders 72 of the dynode 50, the mesh member 56 cannot contact the support plates 58 and be distorted thereby.

The support shoulders 72 also act as locating stops for the dynode 50. Each of the shoulders 72 has a width, W, of about 7.11±0.13 mm (0.280±0.005 inches), and the support slots 74 formed in the support plates 58 have a width, w, of about 6.35±0.08 mm, (0.250±0.003 inches). The greater width, W, of the support shoulders 72 act as a positive stop for the dynode 50 to further prevent the mesh member 56 affixed to the dynode 50 from contacting the inside surfaces of the support plates 58. While described in relation to the secondary dynode 50, a similar support shoulder and reference structure is provided on the secondary dynode 42. The ultimate secondary dynode 52 does not utilize a mesh member, but rather, has a large input aperture between the penultimate secondary dynode 50 and the anode 54.

Figure 5:
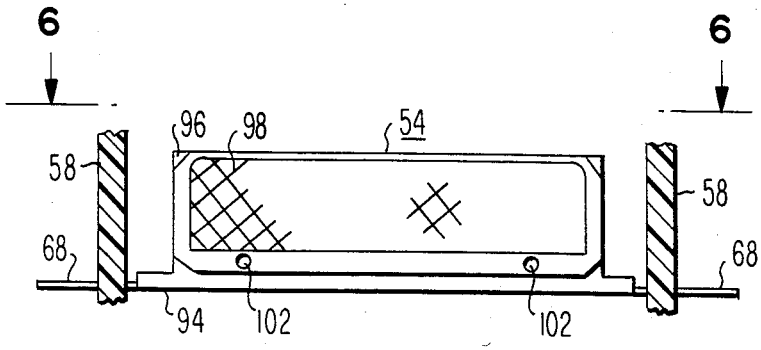
FIG. 5 is a fragmentary view of an anode of the electron multiplier cage assembly showing the mesh member attached thereto.
Figure 6:
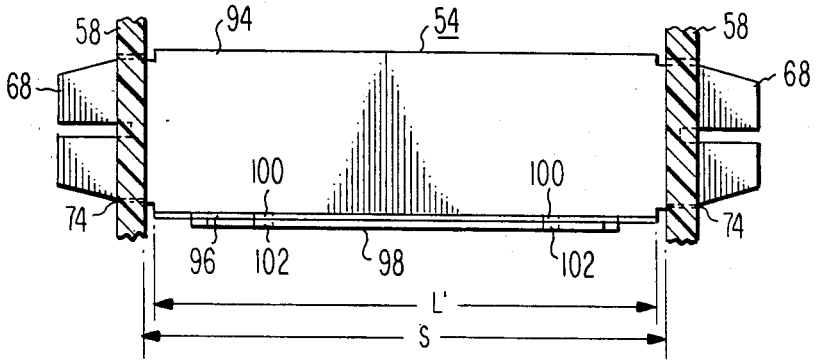
FIG. 6 is a view taken along line 6—6 of FIG. 5.

The anode 54 is shown in FIGS. 5 and 6. The anode 54 comprises a base portion 94, a frame portion 96, which extends substantially perpendicular to the base portion 94, and an anode mesh member 98 attached to said frame portion 96. The mesh member 98 is the active portion of the anode which collects the secondary electrons from the ultimate dynode 52. The frame portion 96 includes at least two reference apertures 100 formed through the lower portion thereof which provide reference means for the mesh member 98. A corresponding pair of locating apertures 102 are formed through the lower portion of the anode mesh member 98 to facilitate alignment of the mesh member 98 with the frame portion 96. Alignment is achieved by the use of alignment pins (not shown) during the fabrication of the cage assembly 32. The anode mesh member 98 is then welded to the frame portion 96 of the anode 54. The base portion 94 includes integral support shoulders at opposite sides thereof which act as locating stops for the anode 54 in the manner described above for the secondary electrode 50. A pair of end tabs 68 extend from the support shoulders of the base portion 94. The end tabs 68 are disposed in the support slots 74 formed in the support plates 58. As shown in FIG. 6, the transverse dimension, L', as measured across the support shoulders of the base portion 94 of the anode 54, is about 21.84±0.05 mm, the same as that for the secondary dynode 50. Since the transverse spacing, S, between the support spacers 58 is about 22.05±0.05 mm, a slight gap also exists between the edges of the support shoulders of the base 94 and the inside surface of the support spacers 58 so that the anode is not distorted by compressive forces provided by the support spacers 58.

What is claimed is:

1. In a photomultiplier tube comprising an evacuated envelope having therein a photoemissive cathode, a shield cup spaced from said cathode, and an electron multiplier cage assembly abutting said shield cup, said cage assembly including a pair of transversely spaced insulating support plates having a plurality of support slots formed therethrough, said plates being attached to said shield cup, and a plurality of electrodes disposed between said support plates, said electrodes having an active portion and attachment means disposed within said support slots of said plates to support said electrodes therebetween, at least one of said electrodes having a mesh member attached thereto, the improvement comprising said electrodes having support shoulders formed in opposite sides thereof between said active portion and said attachment means, said support shoulders having a width greater than that of said slots whereby said shoulders provide stop locations adjacent to said support plates, at least one of said electrodes including reference means and said mesh member including locating means, said locating means being aligned with said reference means of said at least one electrode.

2. The tube as in claim 1, wherein said electrodes include a primary dynode, a plurality of secondary dynodes and an anode.

3. The tube as in claim 2, wherein each of said secondary dynodes has reference means formed in each of said shoulders and a mesh member attached thereto, said mesh member having locating means therein which are aligned with said reference means of said secondary dynode, said mesh member having a length less than the transverse dimension of said shoulders of said secondary dynode whereby said mesh member cannot contact said support plates and be distorted thereby.

4. The tube as in claim 2, wherein said anode comprises a base portion, a frame portion extending substantially perpendicular to said base portion, and an anode mesh member attached to said frame portion, said base portion having said support shoulders formed therein with said attachment means extending outwardly from said support shoulders, said frame portion having reference means formed therein, said anode mesh member having locating means formed therein which are aligned with said reference means of said frame portion.

5. In a photomultiplier tube comprising an evacuated envelope having a faceplate portion with an interior surface, a photoemissive cathode disposed on said interior surface for emitting photoelectrons in response to radiation incident thereon, a shield cup spaced from said cathode, an electron multiplier cage assembly abutting said shield cup, said electron multiplier cage assembly including a pair of transversely spaced, substantially parallel insulating support plates having a plurality of support slots formed therethrough, one end of said plates being attached to said shield cup, a light shield transversely disposed between the other end of said plates, a primary dynode for receiving photoelectrons from said cathode and for emitting secondary electrons in response thereto, an anode for collecting said electrons, a plurality of secondary dynodes disposed between said primary dynode and said anode, said secondary dynodes having an active portion for propagating and concatenating electron emission therebetween, said dynodes and said anode being disposed between said support plates and attached thereto by a pair of oppositely projecting tabs extending from the sides thereof, and a plurality of mesh members, said mesh members being attached to less than all of said secondary dynodes, the improvement comprising a pair of support shoulders formed in said sides of each of said secondary dynodes between said active portion and said tabs, said support shoulders having a width greater than that of said slots in said support plates whereby said shoulders provide stop locations against said support plates, each of said shoulders having a reference aperture formed therein, and said mesh members attached to said secondary dynodes having locating slots formed therein, said locating slots being aligned with said reference apertures, said mesh members attached to said secondary dynodes having a length less than the transverse dimension of said shoulders of said secondary dynodes whereby said mesh members do not contact said support plates.

6. The tube as in claim 5, wherein said anode comprises a base portion, a frame portion extending substantially perpendicular to said base portion and an anode mesh member attached to said frame portion, said base portion having said support shoulders formed therein with said attachment means extending outwardly from said support shoulders, said frame portion having reference means formed therein, said anode mesh member having locating means formed therein which are aligned with said reference means of said frame portion.

* * * * *